US007531747B2

(12) United States Patent
Tamm et al.

(10) Patent No.: US 7,531,747 B2
(45) Date of Patent: May 12, 2009

(54) ENERGY DIRECTING UNITIZED CORE GRIP FOR ELECTRICAL CONNECTOR

(75) Inventors: Carl R. Tamm, Trussville, AL (US); Robert G. Hay, Pelham, AL (US)

(73) Assignee: Hubbell Incorporated, Orange, CT (US)

( * ) Notice: Subject to any disclaimer, the term of this patent is extended or adjusted under 35 U.S.C. 154(b) by 377 days.

(21) Appl. No.: 11/492,222

(22) Filed: Jul. 25, 2006

(65) Prior Publication Data

US 2007/0029102 A1 Feb. 8, 2007

Related U.S. Application Data

(60) Provisional application No. 60/704,882, filed on Aug. 3, 2005.

(51) Int. Cl.
*H01R 4/00* (2006.01)

(52) U.S. Cl. ..... 174/84 R; 174/84 C

(58) Field of Classification Search ..... 174/74 R, 174/77 R, 84 R, 88 R, 89, 92, 94 R, 84 C
See application file for complete search history.

(56) References Cited

U.S. PATENT DOCUMENTS 1,744,190 A 1/1930 Wilson
3,052,750 A 9/1962 Cobaugh
3,065,004 A * 11/1962 Hermann ..... 403/278
3,125,630 A * 3/1964 Wahl ..... 174/94 R
3,236,968 A 2/1966 Toedtman
3,322,888 A 5/1967 Zemels
3,704,048 A * 11/1972 Yoshikawa et al. ..... 384/192
3,996,417 A * 12/1976 Annas ..... 174/90
4,453,034 A 6/1984 Annas et al.
4,511,280 A * 4/1985 Saint-Prix et al. ..... 403/274
4,784,707 A * 11/1988 Wefers et al. ..... 156/48
4,829,146 A 5/1989 Duve
4,893,765 A * 1/1990 Randolph ..... 242/571.6
4,950,838 A 8/1990 Gordon
6,261,137 B1 * 7/2001 Wilcox ..... 439/877
7,385,138 B2 * 6/2008 De France et al. ..... 174/84 R

* cited by examiner

*Primary Examiner*—William H Mayo, III
(74) *Attorney, Agent, or Firm*—Jenae C. Gureff; Mark S. Bicks; Alfred N. Goodman

(57) ABSTRACT

A unitized core grip for an electrical connector includes a longitudinal shaft, a plurality of lobes connected by a plurality of web members, a generally triangular center bore, and a plurality of axial grooves. The core grip is defined by a plurality of longitudinally extending, circumferentially spaced lobes, spaced about a longitudinal axis. The plurality of web members are spaced between and connecting the lobes. The generally triangular center bore is defined by the interior surfaces of the lobes and the web members, prior to compression for receiving a cable.

19 Claims, 3 Drawing Sheets

ENERGY DIRECTING UNITIZED CORE GRIP FOR ELECTRICAL CONNECTOR

CROSS REFERENCE TO RELATED APPLICATIONS

This application claims the benefit of U.S. Provisional Application 60/704,882, filed Aug. 3, 2005. That application is hereby incorporated by reference in its entirety.

FIELD OF THE INVENTION

The present invention relates to a unitized core grip for an electrical connector. More particularly, the invention relates to a core grip comprising a longitudinal shaft, a plurality of lobes connected by a plurality of web members, a generally triangular center bore, and a plurality of axial grooves.

BACKGROUND OF THE INVENTION

A unitized core grip is disclosed in U.S. Pat. No. 3,996,417 to Annas as having a common extrusion design incorporating three equally disposed outer lobes retained by a circular or right circular cylindrical web member. The web member provides a circular cylindrical bore to receive the exposed, projecting end of a reinforcing core of an electrical conductor, typically an aluminum conductor steel reinforced (ACSR).

ACSR is a concentrically stranded conductor composed of at least one layer of hard-drawn aluminum wire stranded with a high strength coated steel core. The core may include a single wire or multiple strands depending on the size. Corrosion protection is available through the application of grease to the core or infusion of the complete cable with grease.

The existing conventional design provides a comparatively restrictive right circular cylindrical bore, lined with an abrasive grit. The grit enhances the purchase between the core grip and the steel strands typical of ACSR type conductors. The strands of the inner core of ACSR conductors are of very high tensile strength. They have a propensity to unwind and splay outwardly when the conductive aluminum strands are removed to expose the inner core strands. Due to the comparatively close relationship between the inner diameter of the core grip and the outer diameter of the conductor core, substantial difficulty is encountered while attempting to introduce the core strands into a conventional cylindrical bore.

Insertion of the core strands into the bore of the Annas patent device, due to the minimal space provided, results in the ends of the steel strands abutting the abrasive grit, thus scraping them away and pushing them out the opposite end. During the compression operation, insufficient grit is retained within the bore to provide sufficient keying of the internal surface of the core grip with the steel core stranding.

Accordingly, a need exists for a unitized core grip configured with a tri-lobe design including a configuration providing minimal resistance towards buckling. There also exists a need for a unitized core grip that, when compressed, the inner face of the three lobes results in an inner space, without the splaying of strands. Further, a need exists for knee sections of web members having an initial propensity to deflect outwardly, provide much less resistance, and thus more compressive force to move the lobes radially inward into intimate and secure gripping contact against the core of the cable.

SUMMARY OF THE INVENTION

Accordingly, an object of the invention is to provide an improved unitized core grip configured with a generally triangular center bore.

Another object of the invention is to provide a core grip comprising a generally triangularly shaped, compressible bore of a suitable area for receiving steel core strands.

A further object of the invention is to provide a core grip comprising a plurality of web members each linked together by a knee section that provides a propensity for the web members to deflect outwardly.

Yet another object of the invention is to provide a generally triangular center bore with three equally disposed outer sections retained by a circular web member for compressing core reinforced cables.

Still another object of the invention is to provide a core grip having an axial groove through the longitudinal axis of each of its web members.

The foregoing objects are basically attained by providing a core grip for an electrical connector comprising a plurality of lobes, a plurality of web members, and a generally triangular center bore. The plurality of lobes are longitudinally extending and circumferentially spaced about a longitudinal axis. The plurality of web members are spaced between, and connect the lobes. The generally triangular center bore is defined by interior surfaces of the lobes and web members, prior to compression for receiving a cable.

Preferably, the web members each include a knee section disposed midway between each of the lobes to allow the web members to deflect outwardly.

By forming the generally triangular center core grip in this manner, there is a propensity for the web members to deflect outwardly, providing much less resistance so more of the compressive force is available to move the lobes radially inward into intimate and secure gripping contact against the core of the cable.

As used in this application, the terms "top", "bottom", and "side" are intended to facilitate the description of the generally triangular center core grip, and are not intended to limit the generally triangular center core grip of the present invention to any particular orientation.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
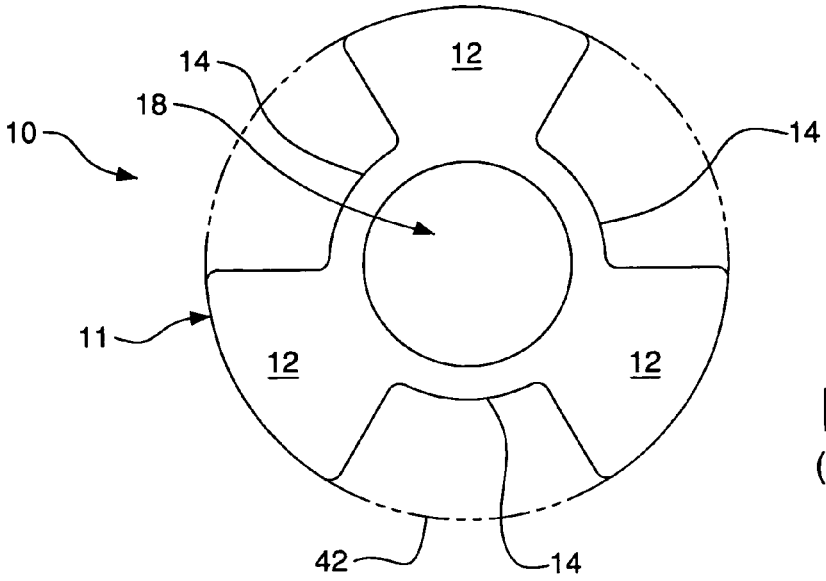
FIG. 1 ( Prior Art )
FIG. 1 is a front, elevational view of the interior section of a unitized core grip according to the prior art.

As seen in FIG. 1, the prior art Annas device 10 is shown, illustrating a core grip 10 for an electrical connector. The Annas device 10 discloses a common extrusion design incorporating three equally disposed outer lobes 12 retained by a circular or right circular cylindrical web member 14. The outer lobes 12 are defined by a continuously arcuate exterior surface 11 that follow the interior surface of a compression barrel 42. The entire exterior surfaces 11 of lobes 12 are in continuous contact with the compression barrel 42. The Annas device 10 provides a circular cylindrical bore 18 to receive the exposed, projecting end of a reinforcing core of an electrical conductor, typical an ACSR.

Figure 2:
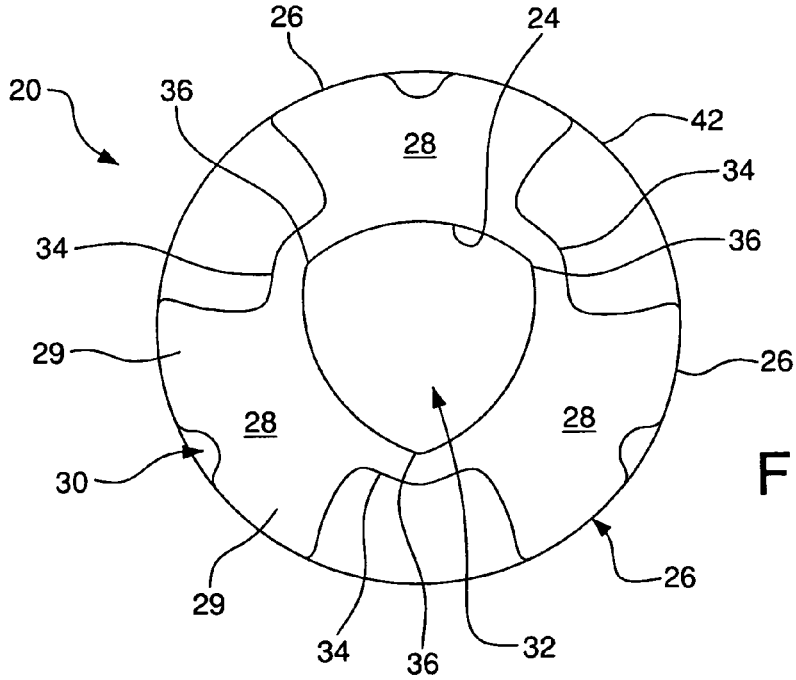
FIG. 2 is a front, elevational view of a unitized core grip according to an embodiment of the present invention.
Figure 3:
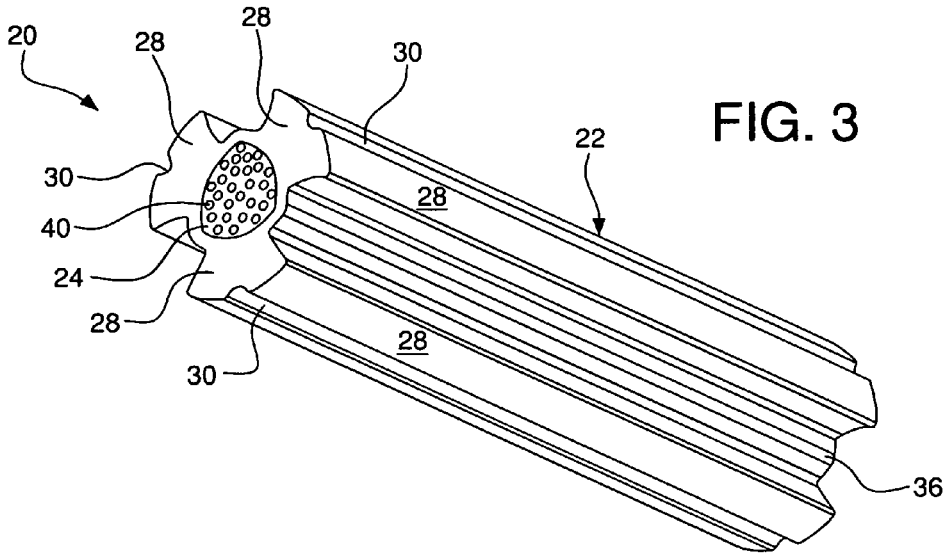
FIG. 3 is a side, perspective view of the unitized core grip of FIG. 2.
Figure 4:
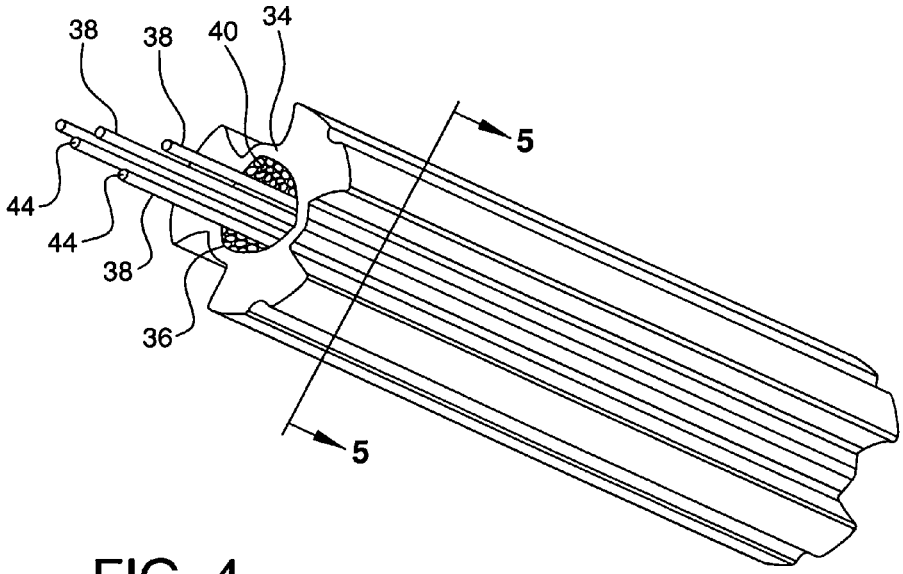
FIG. 4 is a side, perspective view of the unitized core grip in FIGS. 2, 3 with conductive aluminum, or steel core, strands received therein.

The present invention, illustrated in FIGS. 2-4, eliminates the right circular cylindrical bore configuration 18 disclosed with the Annas device 10. A core grip 20 for an electrical connector includes a longitudinal shaft 22 having an interior surface 24 and an exterior surface 26. The shaft 22 is formed of aluminum having a generally triangular center bore 32 running along its longitudinal axis throughout the center of its body. The generally triangular center bore 32 is formed by at least three apexes connected by curved sides. This core grip 20 presents an essentially equivalent minimum diameter inscribed within the definition of a generally triangular center bore 32.

The uncompressed circular cross-sectional area of bore 18 is conventionally 0.181 square inches, whereas the uncompressed cross-sectional area of the generally triangular center bore 32 is preferably 0.201 square inches. When compressed, the interior surface 24 of the core grip 20 results in an interior space of generally triangular center bore 32 that is essentially triangular in shape and equal to the compressed space of the Annas device 10. More area is provided in generally triangular center bore 32 prior to compression of the core grip 20 to accommodate and receive electrical cables or steel core strands 38, thus making it easier for the installer to insert the steel-core strands 38 and for the steel core strands 38 to traverse the interior tri-lobe bore 32 with less restriction than in bore 18, and avoiding dislodging an abrasive grit surface 40 affixed therein.

Three lobes 28 make up the exterior surface 26 of the core grip 20. For the best result, the lobes 28 are circumferentially and equally spaced around the exterior surface 26. Each lobe 28 is splayed outward such that the widest portions 29 of the lobes 28 connect with the interior surface of the compression barrel 42. Each of the lobes 28 is further defined by an axial groove 30 extending parallel to the longitudinal axis of lobe 28. As opposed to the exterior surface 11 of the Annas device 10, the entire exterior surface 26 of each lobe 28 is not in contact with the compression barrel 42 because of the placement of each axial groove 30.

The outermost surfaces 26 of the lobes 28 have the same or slightly greater surface area than the outermost surfaces of the lobes 12 of the Annas device 10. The unique cross-sectional design of the outer lobes 28 provides this area distributes it over a greater percentage of the inner diameter of the compression barrel 42, and utilizes a greater portion of the inward motion produced in the compression process to collapse the gripper and provide maximum compression onto the steel core strands 38.

Each of the web members 34 includes a knee section 36 disposed midway between each of the lobes 28. Each knee section 36 divides the arcuate path of the web member 34, forming a peak between the lobes 28, and facilitating deflecting of the web members 34 outwardly. The web members 34 provide a minimal resistance to buckling during crimping because they have substantial strength such that more of the compressive force is available to move the lobes 28 radially inward into intimate and secure gripping contact against the core of a cable by the knee section 36 absorbing some of the mechanical stress.

The axial grooves 30 are disposed along the longitudinal axis of the approximate center of the exterior surface 26. The grooves 30 provide additional relief through which any grit 40 captured between the outermost surface 26 of the lobes 28 and the interior of the compression barrel 42 will flow. Then, it may easily flow without impeding the insertion of the core grip 20 to its full depth within an electrical connector.

Axial grooves 30 utilize gritted inhibitors with compression fittings. Inhibitors are grease-like compounds which suspend an abrasive grit 40, commonly aluminum oxide. Grit 40 is filled into the triangular center bore 32 upon manufacture, or anytime prior to insertion of the steel core strands 38 and core grip 20 into the compression barrel 42. Due to the space provided in the core grip 20, during insertion of the steel core strands 38 into the center bore 32, the ends 44 of the steel core strands 38 do not abut the grit 40 and are able to stay together without being pushed out an opposite end.

Figure 5:
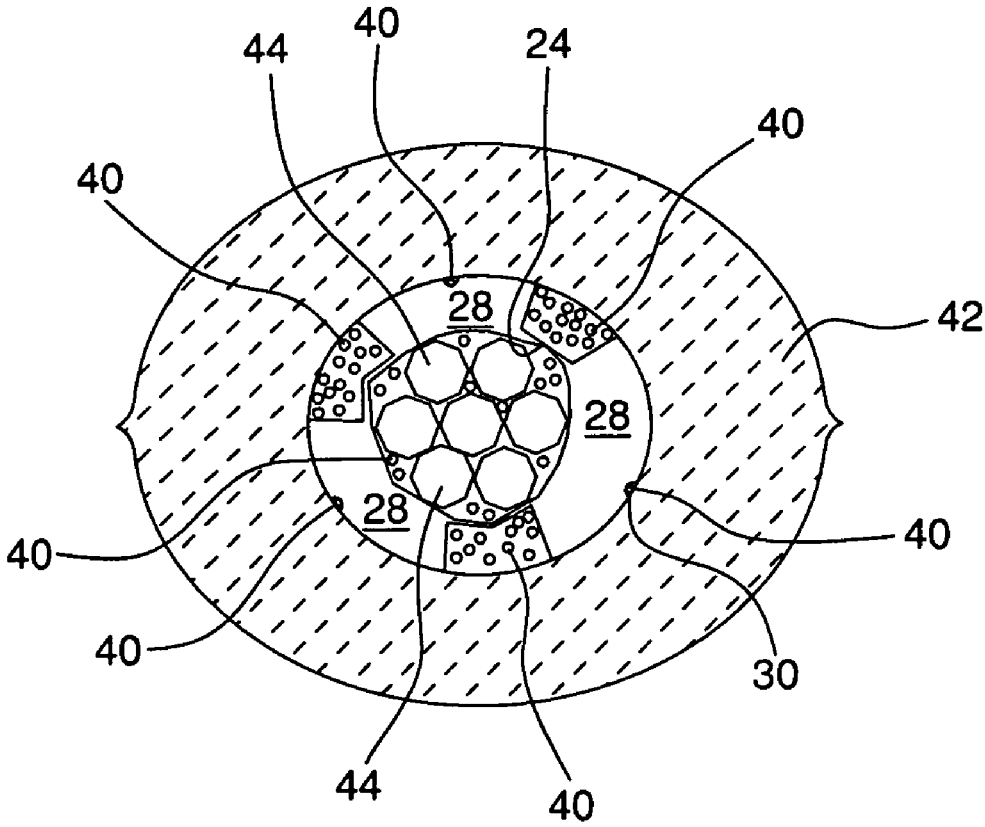
FIG. 5 is a transverse view in cross section of the core grip taken along line 5-5 of FIG. 4 after the core grip is compressed.

When the core grip is inserted into the compression barrel, the core grip 20 must pass through the grit 40, thus forcing the grit 40 to flow around the core grip 20, between the three lobes 28 and about the annular section between the outermost surface of the three lobes 28 and the triangular center bore 32. When the core grip 20 is in compression, as illustrated in FIG. 5, through a compression barrel 42, the three lobes 28 are compressed radially inwardly. Grit 40 is retained within the center bore 32 to provide sufficient keying of the interior surface 24 of the core grip 20 with the steel core strands 38. The grit 40 suspended within the inhibitor often provides significant resistance to insertion of the core grip 20 into the compression barrel 42, as it tends to bind between the outermost surface of the three lobes 28 and triangular center bore 32, thus locking the core grip 20 within the compression barrel 42 prior to it being inserted to its full depth.

While a particular embodiment has been chosen to illustrate the invention, it will be understood by those skilled in the art that various changes and modifications can be made therein without departing from the scope of the invention as defined in the appended claims.

What is claimed is:

1. A core grip for an electrical connector comprising:

a plurality of longitudinally extending, circumferentially spaced lobes, spaced about a longitudinal axis;

a plurality of web members spaced between and connecting said lobes; and a substantially triangular center bore defined by interior surfaces of said lobes and said web members, prior to compression for receiving a cable.

2. A core grip according to claim 1 wherein said spaced lobes comprise axial grooves extending along an exterior surface disposed on centers of said lobes.

3. A core grip according to claim 2 wherein each of said axial grooves is positioned parallel to said longitudinal axis.

4. A core grip according to claim 1 wherein said spaced lobes extend radially outwardly from said web members.

5. A core grip according to claim 4 wherein
said spaced lobes include a plurality of outer surfaces disposed in a common circle.

6. A core grip according to claim 5 wherein
said spaced lobes are received in a compression barrel adapted to restrict outward movement of said spaced lobes wherein
said compression barrel prevents said core grip from releasing said cables.

7. A core grip according to claim 1 wherein
each of said web members includes a knee disposed midway between each of said lobes to allow said web members to deflect outwardly.

8. A core grip according to claim 7 wherein
said knee extends parallel to said longitudinal axis.

9. A core grip according to claim 8 wherein
an axial groove is positioned parallel to said longitudinal axis.

10. A core grip according to claim 1 wherein
a plurality of steel strands are enclosed within said core grip and prevented from splaying outwardly.

11. A core grip according to claim 10 wherein
said interior surface is coated with an abrasive to enhance the contact between said bore and said plurality of steel strands.

12. A core grip according to claim 11 wherein
said abrasive surrounds said core grip when said core grip is inserted into a compression barrel adapted to restrict outward movement of said spaced lobes.

13. A core grip for an electrical connector comprising:
a plurality of longitudinally extending, circumferentially spaced lobes, spaced about a longitudinal axis and extending radially outwardly from a plurality of web members therebetween, each of said web members including a knee on an interior surface for deflecting outwardly;
an axial groove extending along an exterior surface on centers of each of said lobes;
a substantially triangular center bore defined by interior surfaces of said lobes and said web members, prior to compression for receiving a cable; and
a plurality of steel strands are encased by said core grip to prevent said strands from splaying outwardly.

14. A core grip according to claim 13 wherein
said axial groove is positioned parallel to said longitudinal axis.

15. A core grip according to claim 13 wherein
said spaced lobes include a plurality of outer surfaces disposed in a common circle.

16. A core grip according to claim 15 wherein
the outer surfaces are received in a compression barrel adapted to restrict outward movement of said spaced lobes wherein
said compression barrel prevents said core grip from releasing said cables.

17. A core grip according to claim 13 wherein
said knee extends parallel to said longitudinal axis.

18. A core grip according to claim 17 wherein
said axial groove is positioned parallel to said longitudinal axis.

19. A core grip according to claim 13 wherein
said interior surface is coated with an abrasive to enhance the contact between said bore and said plurality of steel strands.

* * * * *